US008245635B2

(12) United States Patent
Kim et al.

(10) Patent No.: US 8,245,635 B2
(45) Date of Patent: Aug. 21, 2012

(54) AUTOMATIC ALIGNMENT APPARATUS FOR RUBBER BANDS

(75) Inventors: Chi Hyun Kim, Daegu (KR); Hee Soo Woo, Daegu (KR)

(73) Assignee: Zeus Techno, Inc. (KR)

( * ) Notice: Subject to any disclaimer, the term of this patent is extended or adjusted under 35 U.S.C. 154(b) by 375 days.

(21) Appl. No.: 12/707,573

(22) Filed: Feb. 17, 2010

(65) Prior Publication Data

US 2011/0072986 A1 Mar. 31, 2011

(30) Foreign Application Priority Data

Sep. 25, 2009 (KR) ..... 10-2009-0090803

(51) Int. Cl.
*B65B 53/00* (2006.01)
*B65B 11/00* (2006.01)

(52) U.S. Cl. ..... 100/9; 53/390; 53/585

(58) Field of Classification Search ..... 100/9; 53/390, 53/582, 585, 592
See application file for complete search history.

(56) References Cited

U.S. PATENT DOCUMENTS 2,236,936 A * 4/1941 Camp ..... 100/9
3,964,380 A * 6/1976 Meyer et al. ..... 100/9
3,974,762 A * 8/1976 Kita et al. ..... 100/9
5,588,278 A * 12/1996 Wynn et al. ..... 53/399

* cited by examiner

*Primary Examiner* — Jimmy T Nguyen
(74) *Attorney, Agent, or Firm* — John K. Park; Park Law Firm

(57) ABSTRACT

Disclosed is an automatic alignment apparatus for rubber bands which automatically aligns a rubber band so as to automate a rubber banding process. The automatic alignment apparatus for rubber bands includes a pair of alignment rods installed in parallel on a plate, screw grooves respectively formed on outer circumferential surfaces of the alignment rods, alignment grooves formed on upper parts of the alignment rods, limit parts formed above the alignment grooves to prevent an aligned rubber band from being separated from the alignment rods, a driving unit and a power transmission unit to rotate the alignment rods, a first sensing unit to sense the rubber band aligned by rotation of the alignment rods, a second sensing unit to sense a consumption state of rubber bands temporarily banded onto the alignment rods, and a controller.

12 Claims, 14 Drawing Sheets

【FIG. 1】
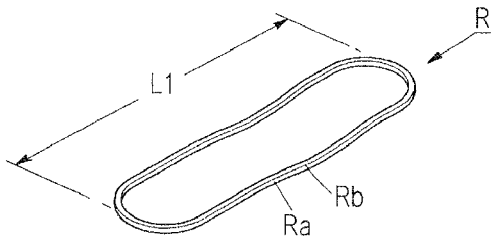
【FIG. 2】
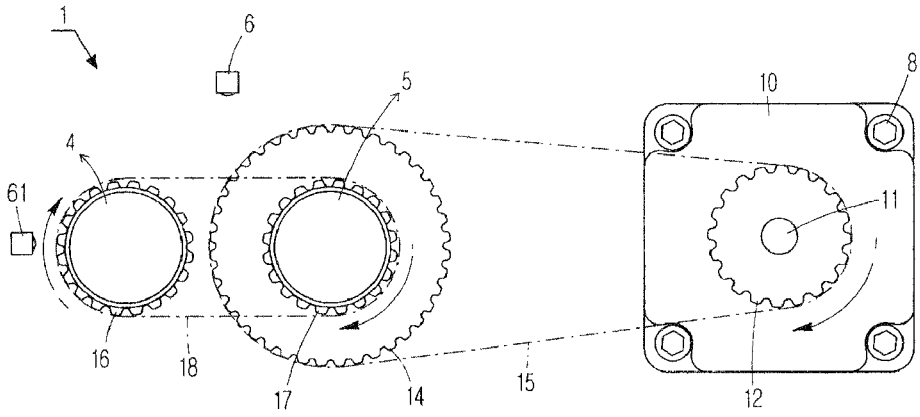

【FIG. 3】
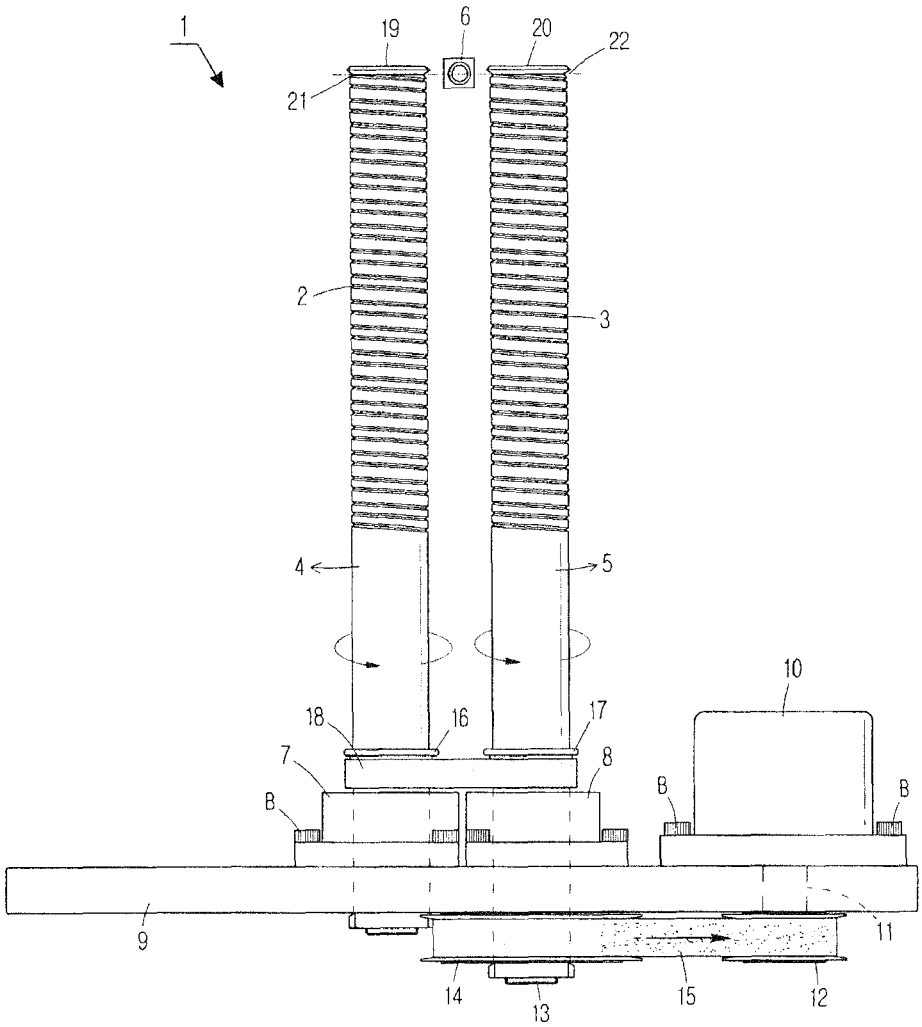

【FIG. 4】
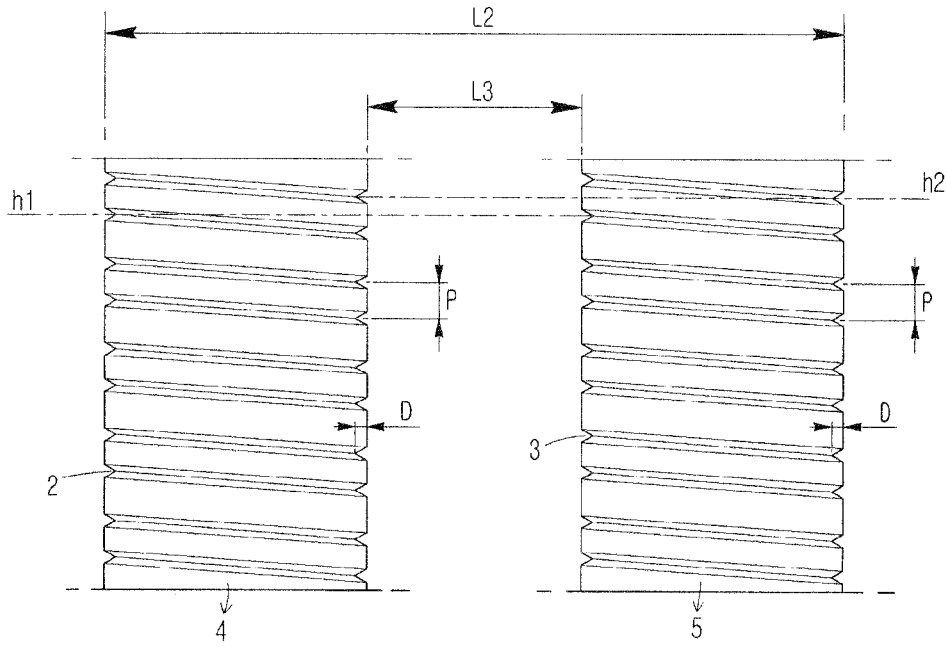

【FIG. 5】
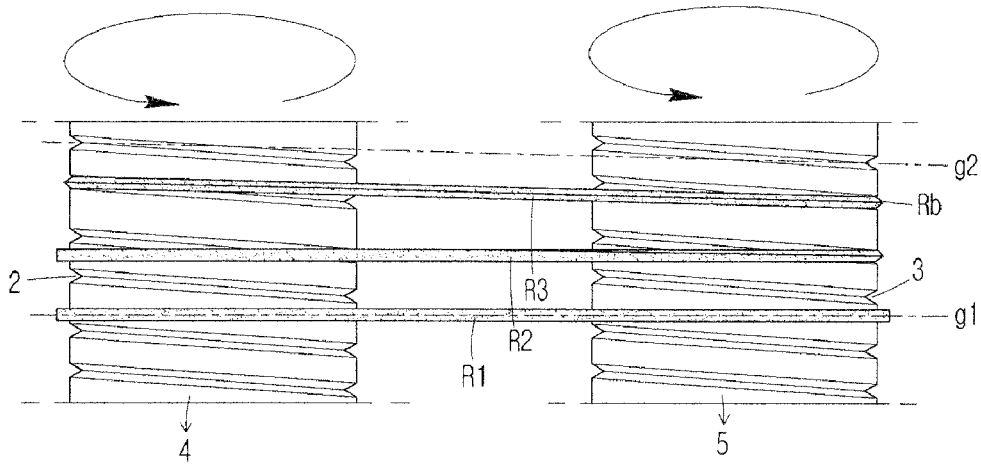

【FIG. 6】
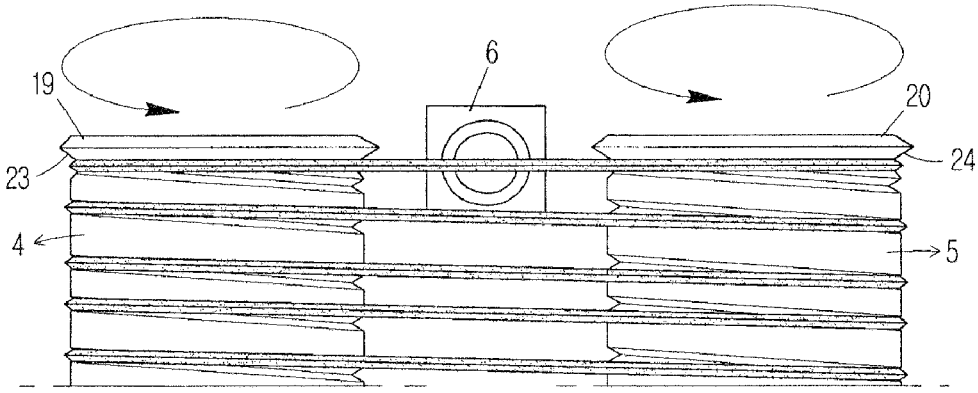

【FIG. 7】
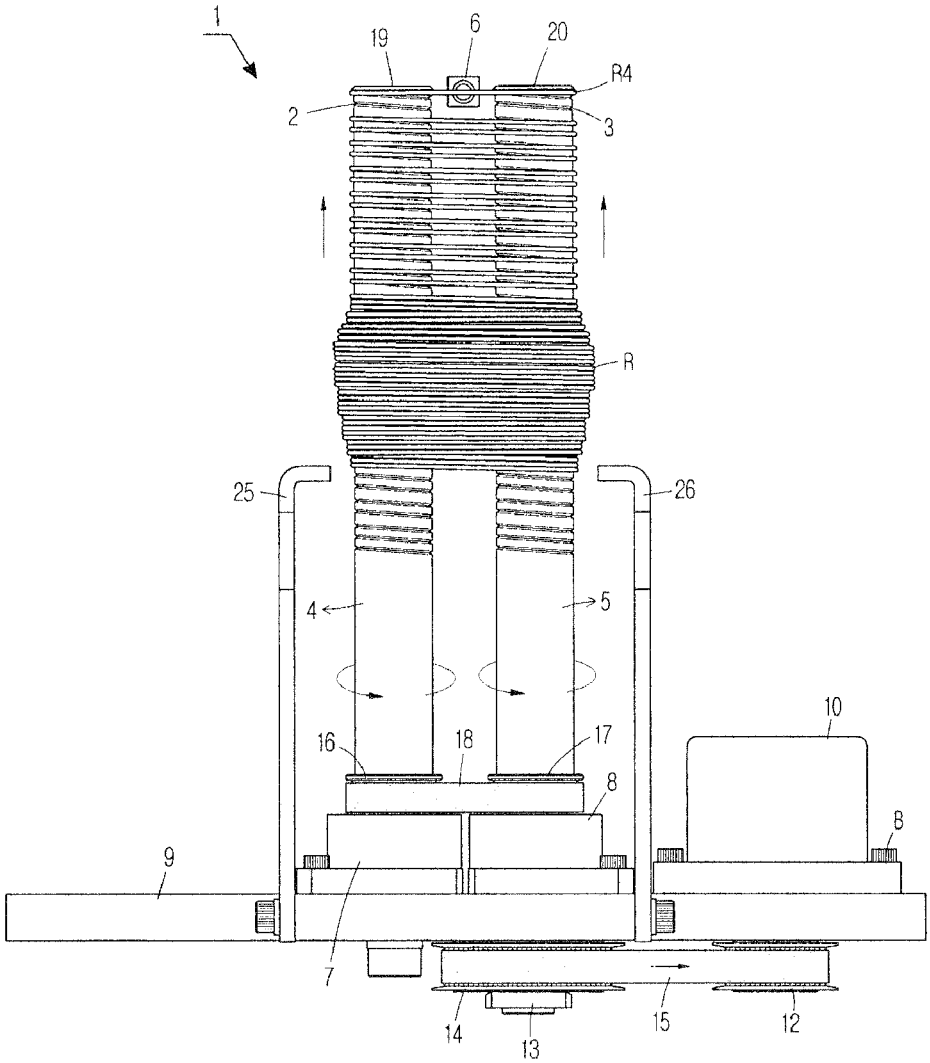

【FIG. 8】
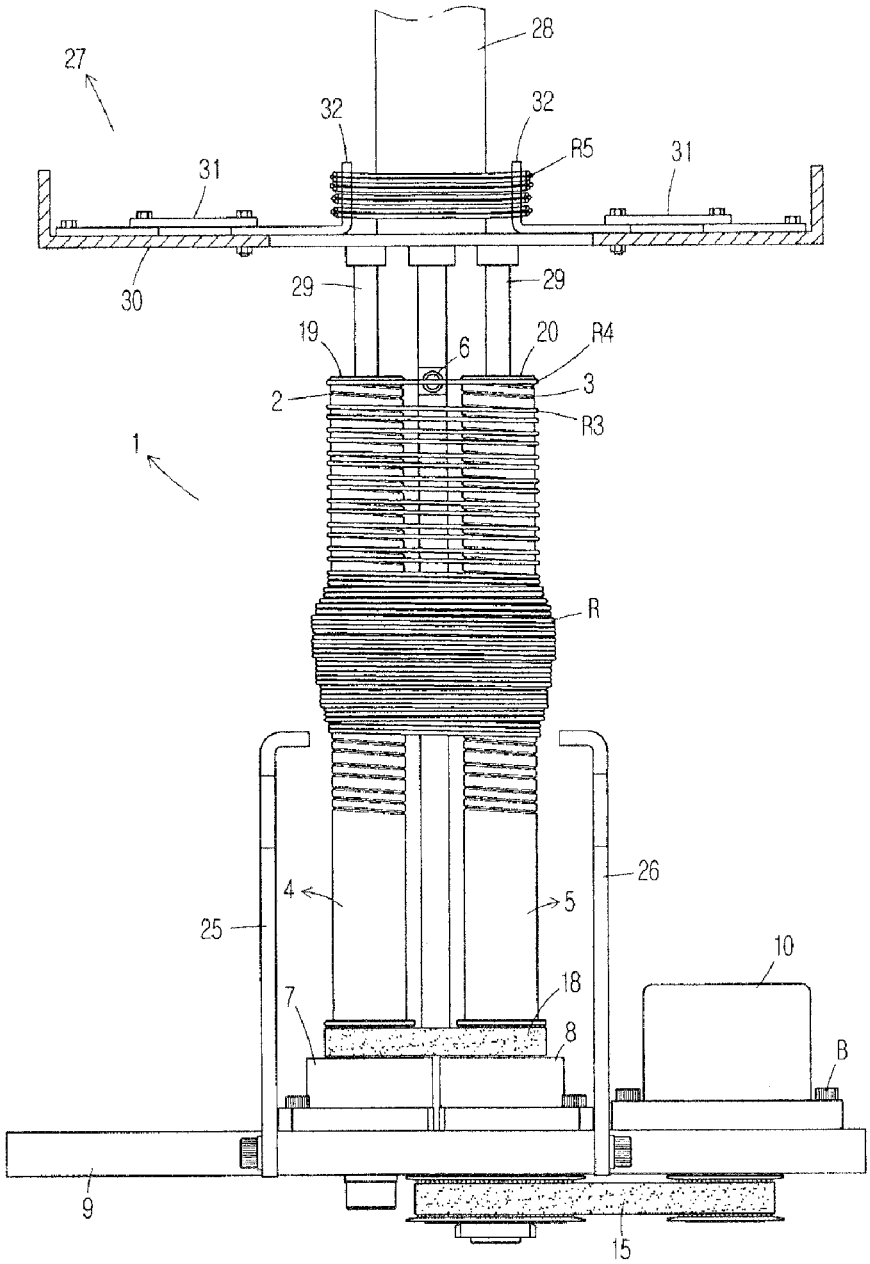

【FIG. 9】
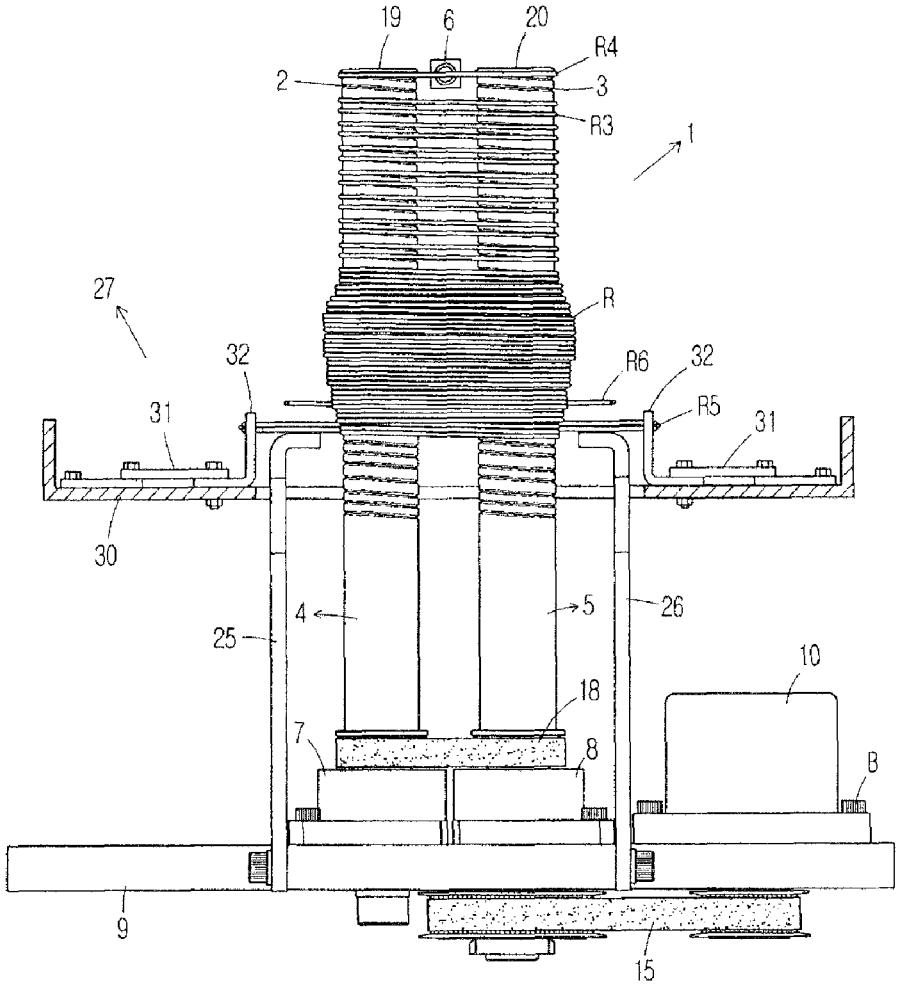

【FIG. 10】
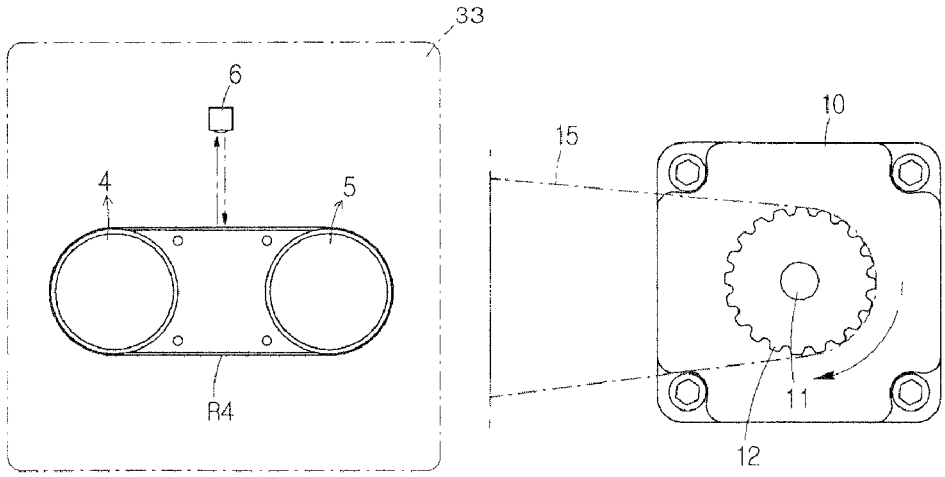

【FIG. 11】
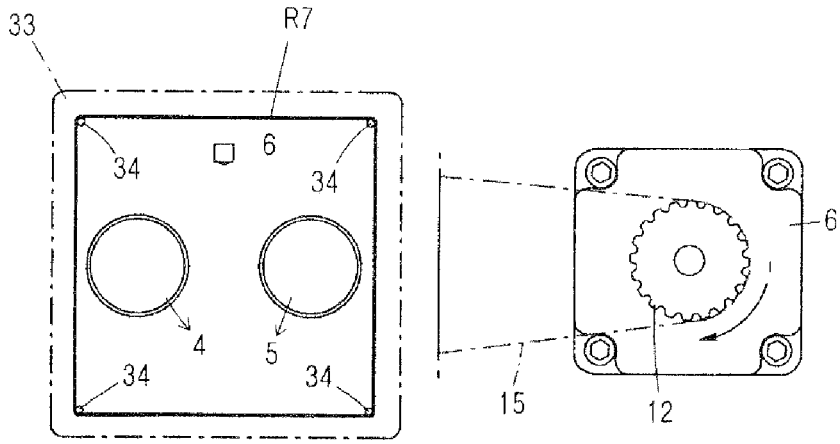

【FIG. 12】
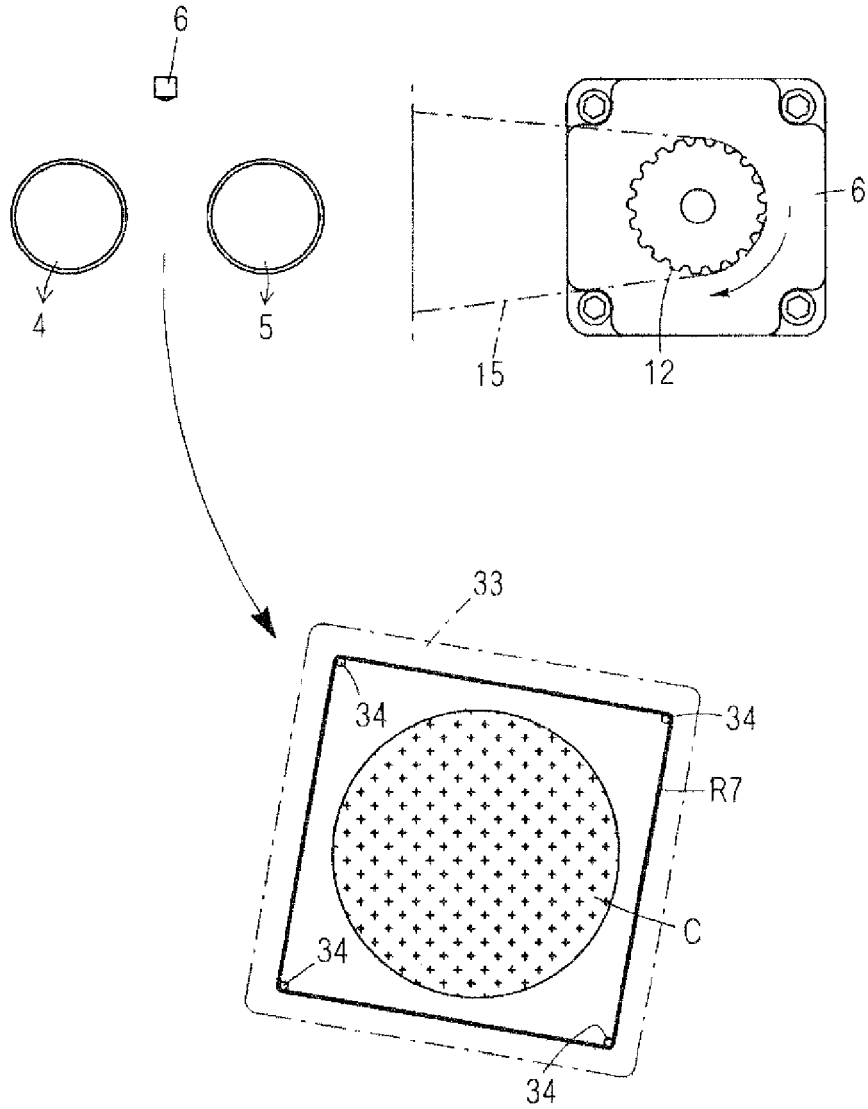

【FIG. 13】
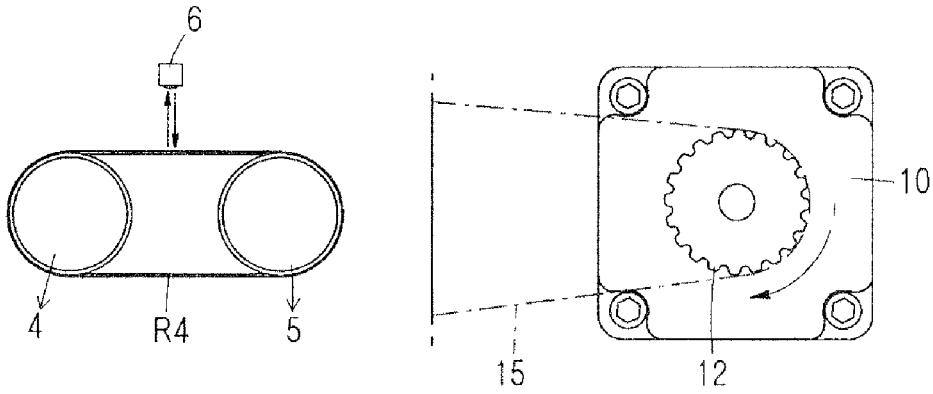
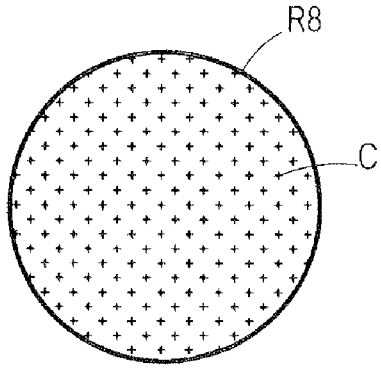

【FIG. 14】
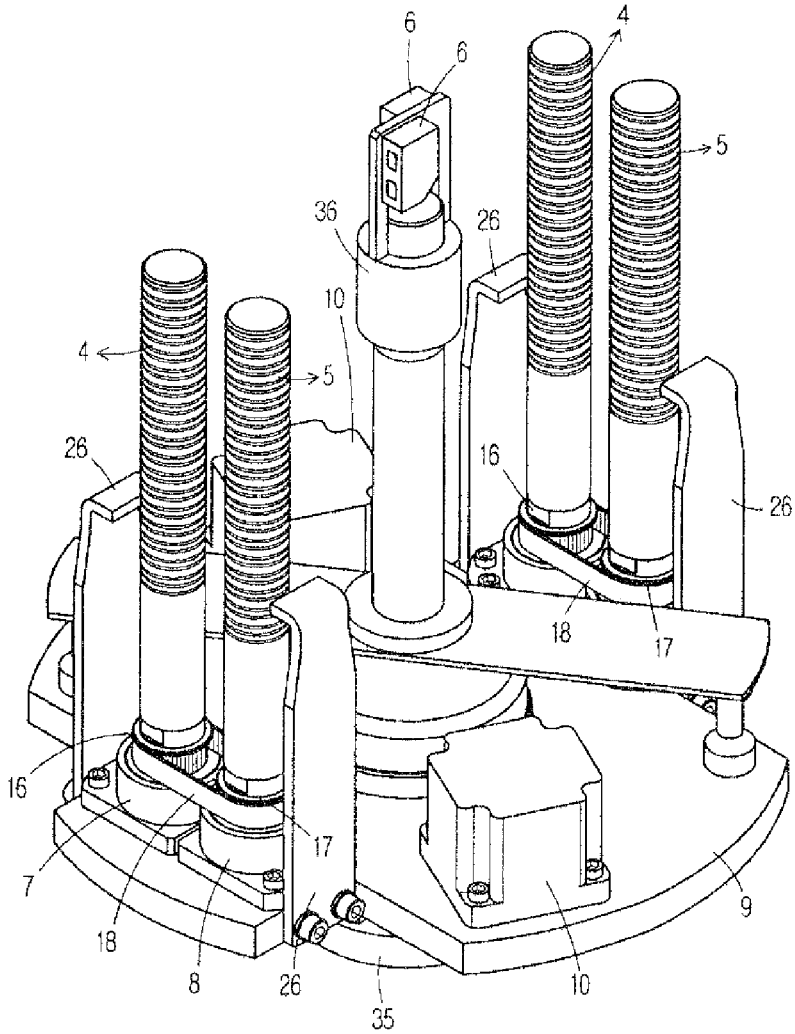

【FIG. 15】
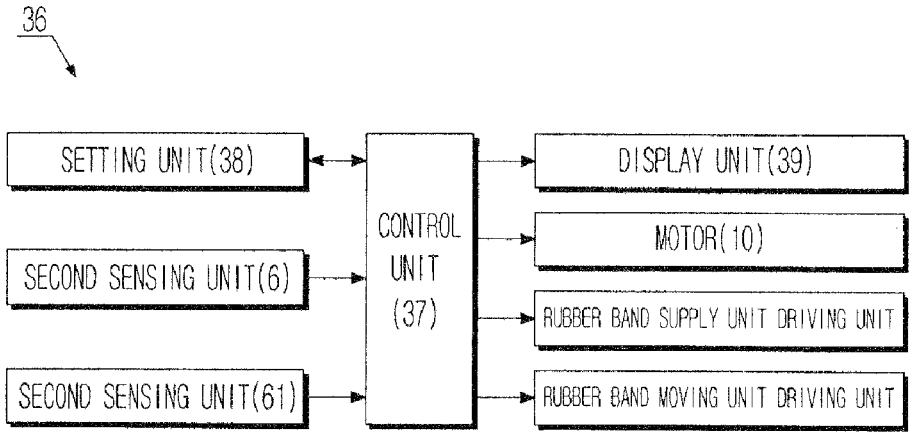

AUTOMATIC ALIGNMENT APPARATUS FOR RUBBER BANDS

BACKGROUND OF THE INVENTION

1. Field of the Invention

The present invention relates to an automatic alignment apparatus for rubber bands which automatically aligns a rubber band so as to automate a rubber banding process.

2. Description of the Related Art

In general, rubber bands are widely used to bind several materials or articles (hereinafter, referred to as 'products') due to low cost, excellent elasticity (flexibility), and toughness thereof.

FIG. 1 is a perspective view of an endless-type rubber band R which is favorably used for various purposes in several industrial fields.

Since there no unit or method to automatically band various products with such a rubber band, the rubber band is banded to a product by worker's hand operation, thereby causing problems, such as lowering of overall productivity and increased production costs. These problems are substantially caused by absence of a tool, a unit, or a method to align an elastic rubber band to a designated position.

SUMMARY OF THE INVENTION

Therefore, the present invention has been made in view of the above problems, and it is an object of the present invention to provide an automatic alignment apparatus for rubber bands which automatically aligns a rubber band so as to automate a rubber banding process.

In accordance with the present invention, the above and other objects can be accomplished by the provision of an automatic alignment apparatus for rubber bands including a pair of alignment rods installed in parallel on a plate, screw grooves respectively formed on outer circumferential surfaces of the alignment rods, alignment grooves formed on upper parts of the alignment rods, limit parts formed above the alignment grooves to prevent an aligned rubber band from being separated from the alignment rods, a driving unit and a power transmission unit to rotate the alignment rods, a first sensing unit to sense the rubber band aligned by rotation of the alignment rods, a second sensing unit to sense a consumption state of rubber bands temporarily banded onto the alignment rods, and a controller.

The driving unit and power transmission unit may include a motor installed at one side of the plate, a shaft of the motor, protruded downwardly from the lower part of the plate, a first timing pulley fixed to the shaft, a shaft of one alignment rod, protruded from the lower part of the plate, a second timing pulley fixed to the shaft of the alignment rod, a first timing belt to connect the first timing pulley and the second timing pulley, a third timing pulley and a fourth timing pulley having the same size and respectively fixed to the lower parts of the alignment rods, and a second timing belt to connect the third timing pulley and the fourth timing pulley.

The alignment rods may have one cross-sectional shape selected from the group consisting of a circle, an oval, and a polygon, and an outer distance between the alignment rods may be slightly larger than an outer distance of a rubber band to be aligned such that the rubber band may be elastically hung on the alignment rods.

Further, the screw grooves formed on the outer circumferential surfaces of the alignment rods may be formed at the same pitch and the same depth in the same direction.

Left heights of the screw grooves formed on the pair of the alignment rods may be the same and right heights of the screw grooves may be the same.

Inclined planes may be formed on the lower surfaces of the edges of the limit parts formed on the uppermost parts of the alignment rods so as to allow the rubber band to be separated from the alignment rods without damage to the rubber band.

Further, plural pairs of alignment rods may be installed in parallel at the edge of the plate so as to achieve rubber band alignment, thereby further improving the productivity of the automatic alignment apparatus for rubber bands.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view of a rubber band;

FIG. 2 is a plan view of an automatic alignment apparatus for rubber bands in accordance with one embodiment of the present invention;

FIG. 3 is a front view of the automatic alignment apparatus for rubber bands in accordance with the embodiment of the present invention;

FIG. 4 is a partially enlarged front view illustrating alignment rods in accordance with the embodiment of the present invention;

FIG. 5 is an enlarged front view illustrating the alignment rods in accordance with the embodiment of the present invention in a rubber band aligned state;

FIG. 6 is an enlarged front view illustrating the alignment rods in accordance with the embodiment of the present invention in a rubber band alignment completed state;

FIG. 7 is a front view of the automatic alignment apparatus for rubber bands in accordance with the embodiment of the present invention in the rubber band aligned state;

FIG. 8 is a front view of the automatic alignment apparatus for rubber bands in accordance with the embodiment of the present invention, illustrating a rubber band supply unit ascending above the alignment rods;

FIG. 9 is a front view of the automatic alignment apparatus for rubber bands in accordance with the embodiment of the present invention, illustrating the rubber band supply unit descending so as to supply rubber bands to the alignment rods;

FIG. 10 is a plan view of the automatic alignment apparatus for rubber bands in accordance with the embodiment of the present invention, illustrating the rubber band moving unit moving above an aligned rubber band;

FIG. 11 is a plan view of the automatic alignment apparatus for rubber bands in accordance with the embodiment of the present invention, illustrating the aligned rubber band spread using hooks;

FIG. 12 is a plan view of the automatic alignment apparatus for rubber bands in accordance with the embodiment of the present invention, illustrating the spread rubber band moving above a product by the rubber band moving unit;

FIG. 13 is a plan view of the automatic alignment apparatus for rubber bands in accordance with the embodiment of the present invention, illustrating the product banded with the rubber band;

FIG. 14 is a perspective view of an automatic alignment apparatus assembly for rubber bands in accordance with another embodiment of the present invention; and FIG. 15 is a circuit block diagram of a controller in accordance with one embodiment of the present invention.

DETAILED DESCRIPTION OF THE INVENTION

Now, preferred embodiments of the present invention will be described in detail with reference to the annexed drawings. In the following description of the present invention, the same or similar elements are denoted by the same reference numerals even though they are depicted in different drawings, and a detailed description of known functions and configurations incorporated herein will be omitted when it may make the subject matter of the present invention rather unclear.

Rubber bands automatically aligned in the present invention are formed in an endless type having a designated elasticity, a designated cross-sectional area, and a designated inner diameter (or a designated outer diameter) so as to bind various materials or articles, as shown in FIG. 1, and have a cross-sectional shape of a rectangle, a circle, an oval, a polygon, or deformations thereof. If the rubber bands have a rectangular cross-sectional shape, each of the rubber bands includes four planes Ra and four corners Rb.

FIGS. 2 and 3 are plan and front views of an automatic alignment apparatus 1 for rubber bands in accordance with one embodiment of the present invention, respectively. The automatic alignment apparatus 1 for rubber bands includes a pair of alignment rods 4 and 5 installed in parallel and respectively provided with screw grooves 4 and 5 having a designated pitch formed on outer circumferential surfaces thereof having the same size, a driving unit and a power transmission unit to rotate the alignment rods 4 and 5, a first sensing unit 6 to sense movement of a rubber band R to a designated position by the rotation of the alignment rods 4 and 5 and thus to stop the rotation of the alignment rods 4 and 5, and a second sensing unit 61 and a controller 36 to sense a consumption state of rubber bands R temporarily banded to the alignment rods 4 and 5 and thus to supply new rubber bands R to the alignment rods 4 and 5.

Shaft supports 7 and 8 are respectively installed at lower parts of the alignment rods 4 and 5. The shaft supports 7 and 8 are installed on a fixing member, for example, a plate 9 so as to be freely rotatable.

The alignment rods 4 and 5 are vertically installed on the plate 9 such that they are parallel with each other, and have a comparatively long length so as to sequentially align rubber bands R one by one the condition that a large number of the rubber bands R is banded on the alignment rods 4 and 5 at a time. That is, the alignment rods 4 and 5 are vertically installed in a twin structure.

Although the alignment rods 4 and 5 are vertically installed basically, the alignment rods 4 and 5 may be installed such that they are inclined at a designated angle according to conditions. It is preferable that, even if the alignment rods 4 and 5 are inclined, a parallel state of the alignment rods 4 and 5 be maintained.

Now, the driving unit and the power transmitting unit to rotate the alignment rods 4 and 5 will be described. A motor 10 serving as the driving unit and a plurality of timing pulleys and timing belts serving as the power transmission unit to transmit rotary force of the motor 10 to the alignment rods 4 and 5 are installed at one side of the plate 9.

That is, the driving unit and the power transmission unit include a shaft 11 of the motor 10 protruded downwardly from the lower part of the plate 9, a first timing pulley 12 fixed to the shaft 11, a shaft 13 of the alignment rod 5 protruded from the lower part of the plate 9, a second timing pulley 14 fixed to the shaft 13, a first timing belt 15 to connect the first timing pulley 12 and the second timing pulley 14, a third timing pulley 16 and a fourth timing pulley 17 having the same size and respectively fixed to the lower parts of the alignment rods 4 and 5, and a second timing belt 18 to connect the third timing pulley 16 and the fourth timing pulley 17.

Therefore, when the motor 10 is operated to rotate the shaft 11, the first, second, third, and fourth timing pulleys 12, 14, 16, and 17, and the first and second timing belts 15 and 18 are respectively rotated, and the alignment rods 4 and 5 connected by the second timing belt 18 are rotated in the same direction at the same speed.

The rotational speed of the alignment rods 4 and 5 is set to 1~50 RPM in consideration of a banding speed of a product C with the rubber band R or an operating speed of a rubber band supply unit 27.

Although the alignment rods 4 and 5 have a cross-sectional shape of a circle, an oval, or a polygon, it is preferable that the alignment rods 4 and 5 have a circular cross-sectional shape so as to satisfy a rotating structure and achieve effective rubber band alignment. Further, it is preferable that the alignment rods 4 and 5 have a diameter which is not excessively large or small, for example, 20 times ~40 times the diameter of the rubber bands R to be aligned so as to allow the rubber bands R to be aligned while smoothly rotating.

The motor 10 may be a stepper motor, a servomotor, or an inverter motor, which is precisely controllable.

An outer distance L2 between the alignment rods 4 and 5, as shown in FIG. 4, is larger than an outer distance L1 of the rubber band R to be aligned, as shown in FIG. 1, and thus the rubber band R is elastically hung on the pair of the alignment rods 4 and 5 under the condition that the rubber band R is pulled.

A degree of elasticity of the rubber band R elastically supported by the alignment rods 4 and 5 denotes a state of the rubber band R which is not greatly pulled while not deviating from its original position. That is, this denotes a degree of the rubber band R supported by the alignment rods 4 and 5 at a proper level of elasticity, and it is preferable that a separation distance 13 between the alignment rod 4 and the alignment rod 5 be equal to or slightly larger or smaller than the diameter of the alignment rods 4 and 5. If the size (the outer distance) of the rubber band R is increased, the separation distance 13 between the alignment rods 4 and 5 may be properly adjusted.

Although, in the present invention, the separation distance L3 between the alignment rods 4 and 5 may be fixed in consideration of the size of the rubber band R, a distance between the shaft supports 7 and 8 may be adjusted by forming a long hole through the plate 9, thus allowing the automatic alignment apparatus 1 for rubber bands of the present invention to rapidly cope with variation in the size of the rubber band R. Of course, the second timing belt 13 may be replaced with a new one corresponding to a modified separation distance L3.

Further, the separation distance L3 between the alignment rods 4 and 5 may be adjusted such that temporarily banded rubber bands R are elastically installed on the alignment rods 4 and 5 in consideration of the inner diameter of the rubber band R to be aligned. Of course, such a separation distance L3 may be adjusted manually, or be adjusted automatically such that proper optimum elasticity is applied to the rubber band R in a method of sensing the elasticity of the rubber band R.

As shown in FIG. 4, the screw grooves 2 and 3 respectively provided on the outer circumferential surfaces of the alignment rods 4 and 5 are formed at the same pitch P and the same depth D in the same direction, left heights h1 of the screw grooves 2 and 3, which denote heights of left parts of the screw grooves 2 and 3, are the same, and right height h2 of the screw grooves 2 and 3, which denote heights of right parts of the screw grooves 2 and 3, are the same.

Therefore, when the alignment rods 4 and 5 are rotated in the counterclockwise direction, i.e., a direction of ascending the rubber band, as shown in FIG. 5, a rubber band R1 hung on the alignment rods 4 and 5 in a horizontal state is rotated in the counterclockwise direction along the alignment rods 4 and 5. At this time, a rubber band R2 in surface-contact with the outer circumferential surfaces of the alignment rods 4 and 5 and rotated in the horizontal state is close to the inclined screw grooves 2 and 3. Then, the right corner part of the rubber band R2 is introduced into the screw groove 3 first and thus is ascended along the screw groove 3, and thereafter the left corner part of a rubber band R3 is introduced into the screw groove 2 and this is ascended along the screw groove 2 and aligned in alignment grooves 21 and 22 located at the upper parts of the alignment rods 4 and 5 in a parallel state.

As shown in FIGS. 3 and 6, limit parts 19 and 20 having an outer diameter slightly larger than the outer diameter of the alignment rods 4 and 5 are respectively formed at the uppermost parts of the alignment rods 4 and 6, and the alignment grooves 21 and 22 connected to the screw grooves 2 and 3 and having the same depth as the screw grooves 2 and 3 are formed just under the limit parts 19 and 20 in the circumferential direction. Therefore, the rubber band R4 ascended along the screw grooves 2 and 3 is introduced into the alignment grooves 21 and 22 and is rotated in the horizontal state along the alignment grooves 21 and 22, and the limit parts 19 and 20 prevent the rubber band R4 from being ascended any further or being separated from the alignment rods 4 and 5. Preferably, inclined planes 23 and 24 are respectively formed on the lower surfaces of the edges of the limit parts 19 and 20 so as to allow the rubber band R to be separated from the alignment rods 4 and 5 without damage to the rubber band R.

Since the rubber band R rotated along the alignment rods 4 and 5 is connected to the screw grooves 2 and 3 and thus are elastically supported by the screw grooves 2 and 3, it is possible to prevent the rubber band R from being slipped over the screw grooves 2 and 3 or being idle rotated along the screw grooves 2 and 3.

In the present invention, the rubber band R which is not introduced into the screw grooves 2 and 3 maintains the horizontal state, as shown in FIG. 5. Thereafter, when the rubber band R is ascended along the alignment rods 4 and 5, the rubber band R is ascended in an inclined state at a designated gradient g1 due to a difference between the heights h1 and h2 of the screw grooves 2 and 3. Thereafter, when the rubber band R is introduced into the alignment grooves 21 and 22, the rubber band R is aligned in the horizontal state.

The alignment grooves 21 and 22 are formed horizontally, differing from the screw grooves 2 and 3, and thus allow the rubber band R4 to be rotated along the alignment rods 4 and 5 in the horizontal state, and the limit parts 19 and 20 above the alignment grooves 21 and 22 prevent the rubber band R4 from being ascended any further or being unintentionally separated from the alignment rods 4 and 5.

The first sensing unit 6 is installed at one side of the alignment rods 4 and 5, and senses the rubber band R4 introduced into the alignment grooves 21 and 22 and aligned therein.

The first sensing unit 6 may be a sensor or a switch which can sense the rubber band R4 located in the alignment grooves 21 and 22. For example, a sensor or a switch using ultrasonic waves, infrared beams, or laser beams, or a proximity sensor or a proximity switch may be used as the first sensing unit 6.

When the first sensing unit 6 senses alignment of the rubber band R4, the operation of the motor 10 is stopped, and the rotation of the alignment rods 4 and 5 is stopped. Under this state, as shown in FIG. 11, a rubber band moving unit 33 provided with four hooks 34 moves above the alignment rods 4 and 5 by an actuator (not shown), and the four hooks 34 enter into the aligned rubber band R4 and are stretched in diagonal directions by a link mechanism. Thereby, the rubber band R7 is stretched into a rectangular shape and is separated from the alignment rods 4 and 5. After the rubber band moving unit 33 is ascended by the elevating actuator (not shown), the rubber band moving unit 33 moves above a product C, and then is descended by the elevating actuator, as shown in FIG. 12. Thereafter, the stretched hooks 34 are closed by the reverse operation of the link mechanism, and the rubber band R7 hung on the hooks 34 are separated from the hooks 34 and the separated rubber band R8 is banded to the product C by elasticity, as shown in FIG. 13. Thereafter, the rubber band moving unit 33 is returned to its original position, and enters a standby state so as to move the next rubber band R4.

When the rubber band R4 is removed from the alignment grooves 21 and 22 by the rubber band moving unit 33, the first sensing unit 6 senses the removal of the rubber band R4, the motor 10 is operated to rotate the alignment rods 4 and 5. Thereby, when the uppermost rubber band R3 is ascended into the alignment grooves 21 and 22 and aligned therein, the first sensing unit 6 senses the alignment of the rubber band R3, the operation of the motor 10 is stopped, and the rotation of the alignment rods 4 and 5 is stopped so that the alignment of the rubber band R3 is stopped. Through repetition of this process, automatic alignment of the rubber band R is achieved.

In the present invention, the second sensing unit 61 to sense a consumption state of the rubber bands R is installed at one side of the alignment rods 4 and 5. The second sensing unit 61 is configured so as to sense the consumption state of the rubber bands R temporarily banded to the alignment rods 4 and 5 before the rubber bands R are completely consumed, and to supply new rubber bands R to the alignment rods 4 and 5 by means of the rubber band supply unit 27. The second sensing unit 61 may be a sensor or a switch which can sense the rubber band R4 temporarily banded to the alignment rods 4 and 5. For example, a sensor or a switch using ultrasonic waves, infrared beams, or laser beams, or a proximity sensor or a proximity switch of a non-contact type may be used as the second sensing unit 61. Of course, a sensing unit of a contact type or a mechanical type may be used as the second sensing unit 61.

Here, it is important that the second sensing unit 61 of an any type or in an any method may be used as long as the second sensing unit 61 senses the consumption state of the rubber bands R and allows new rubber bands R to be supplied by means of the rubber band supply unit 27 before the rubber bands R are completely consumed.

FIG. 7 illustrates the automatic alignment apparatus for rubber bands in a rubber band aligned state, and FIGS. 8 and 9 exemplarily illustrate a process of temporarily banding a large number of rubber bands R on the outer circumferential surfaces of the alignment rods 4 and 5 by the rubber band supply unit 27.

As shown in FIG. 8, the rubber band supply unit 27 is ascended and descended by an elevating actuator 28, and is guided by a plurality of guide rods 29.

A through hole to pass the alignment rods 4 and 5 is formed through the center of a plate 30 of the rubber band supply unit 27, and link mechanisms 31 operated by actuators, which are not shown, are installed at both sides of the through hole. A pair of upward bending parts 32 is formed at the link mechanisms 31 such that the bending parts 32 are stretched or closed by the link mechanisms 31.

When a large number of rubber bands R5 is supplied to the bending parts 32 in a closed state, as shown in FIG. 8, by another rubber band supply unit 27, the bending parts 32 are stretched by the link mechanisms 31 and thus the rubber band R5 is extended, as shown in FIG. 9. Thereafter, when the rubber band supply unit 27 is descended by the elevating actuator 28, the rubber band R5 hung on the bending parts 32 is separated from the bending parts 32 by action of takeoff pieces 26 installed on the plate 9 and the separated rubber band R6 is temporarily banded onto the outer circumferential surfaces of the alignment rods 4 and 5. Thereafter, the rubber band supply unit 27 is returned to its original position, and enters a standby state.

FIG. 14 is a perspective view of an automatic alignment apparatus assembly for rubber bands in accordance with another embodiment of the present invention. In this embodiment, a pair of automatic alignment apparatuses 1 for rubber bands is installed at both sides on the upper surface of a plate 9 rotated by a designated angle, for example, an angle of 180°, by a driving unit 35, first sensing units 6 are respectively installed above the center of the plate 9, and second sensing units 61 to sense a consumption state of rubber bands R are respectively installed at designated sides of the alignment rods 4 and 5 so as to allow the rubber bands R to be automatically aligned, thereby doubling the productivity of the automatic alignment apparatus 1 for rubber bands.

Further, in FIG. 14, the plate 9 may be rotated by an angle of 120° by the driving unit 35, three automatic alignment apparatuses 1 for rubber bands may be installed at uniform intervals, corresponding first sensing units 6 may be respectively installed above the center of the plate 9, and corresponding second sensing units 61 sense a consumption state of rubber bands R may be respectively installed at designated sides of the alignment rods 4 and 5 so as to allow the rubber bands R to be automatically aligned, thereby further improving the productivity of the automatic alignment apparatus 1 for rubber bands.

Moreover, in FIG. 14, the plate 9 may be rotated by an angle of 90° by the driving unit 35, four automatic alignment apparatuses 1 for rubber bands may be installed at uniform intervals, corresponding first sensing units 6 may be respectively installed above the center of the plate 9, and corresponding second sensing units 61 to sense a consumption state of rubber bands R may be respectively installed at designated sides of the alignment rods 4 and 5 so as to allow the rubber bands R to be automatically aligned, thereby further improving the productivity of the automatic alignment apparatus 1 for rubber bands.

Although several rubber bands R are banded onto the outer circumferential surfaces of alignment rods 4 and 5, the automatic alignment apparatus 1 for rubber bands of the present invention ascends the rubber bands R along the screw grooves 2 and 3 one by one according to rotation of the alignment rods 4 and 5 and aligns the ascending rubber band R into the alignment grooves 21 and 22, thereby effectively achieving automatic rubber band alignment.

FIG. 15 is a circuit block diagram of the controller in accordance with one embodiment of the present invention. A setting unit 38, the first sensing unit 6 to sense the aligned rubber band R4, and the second sensing unit 61 to sense the consumption state of the rubber bands R temporarily banded onto the alignment rods 4 and 5 are connected to an input side of a control unit 37 including a CPU or a PLC. The setting unit 38 includes a plurality of buttons, i.e., an operation button, a stop button, a reverse rotation button, a reset button, etc., and serves to set an operation time of the automatic alignment apparatus 1 for rubber bands, a rotational speed of the alignment rods 4 and 5, and sensitivities of the first sensing unit 6 and the second sensing unit 61.

A display unit 39 to display an operation state, various setting data, and current data, the motor 10 to drive the alignment rods 4 and 5, a driving unit to drive the rubber band supply unit 27, and a driving unit to drive the rubber band moving unit 33 are connected to an output side of the control unit 37.

If temporary reverse rotation of the alignment rods 4 and 5 is required due to, for example, twisting, misalignment, or maintenance and repair of the aligned rubber band R, the reverse rotation button of the setting unit 38 of the controller 36 is used.

As apparent from the above description, the present invention provides an automatic alignment apparatus for rubber bands which automatically aligns a rubber band at a designated position, thereby being capable of automating a banding process of various products.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An automatic alignment apparatus for rubber bands comprising:

a plate;

a pair of alignment rods installed in parallel on the plate;

screw grooves respectively formed on outer circumferential surfaces of the alignment rods;

alignment grooves formed on upper parts of the alignment rods;

limit parts formed above the alignment grooves;

a driving unit and a power transmission unit to rotate the alignment rods; and a first sensing unit to sense a rubber band aligned by rotation of the alignment rods.

2. The automatic alignment apparatus according to claim 1, wherein each driving unit and power transmission unit includes:

a motor installed at one side of the plate;

a shaft of the motor, protruded downwardly from the lower part of the plate;

a first timing pulley fixed to the shaft;

a shaft of one alignment rod, protruded from the lower part of the plate;

a second timing pulley fixed to the shaft of the alignment rod;

a first timing belt to connect the first timing pulley and the second timing pulley;

a third timing pulley and a fourth timing pulley having the same size and respectively fixed to the lower parts of the alignment rods; and a second timing belt to connect the third timing pulley and the fourth timing pulley.

3. The automatic alignment apparatus according to claim 1, wherein a second sensing unit to sense a consumption state of rubber bands temporarily banded onto the alignment rods is installed at one side of the alignment rods.

4. The automatic alignment apparatus according to claim 1, wherein an outer distance between the alignment rods is larger than an outer distance of a rubber band to be aligned.

5. The automatic alignment apparatus according to claim 1, wherein the screw grooves are formed at the same pitch and the same depth in the same direction.

6. The automatic alignment apparatus according to claim 1, wherein left heights of the screw grooves are the same and right heights of the screw grooves are the same.

7. An automatic alignment apparatus for rubber bands comprising:

a driving unit;

a plate rotated by the driving unit;

plural pairs of alignment rods installed in parallel at the edge of the plate;

screw grooves respectively formed on outer circumferential surfaces of the alignment rods;

alignment grooves formed on upper parts of the alignment rods;

limit parts formed above the alignment grooves;

driving units and power transmission units to rotate the alignment rods; and first sensing units to sense a rubber band aligned by rotation of the alignment rods.

8. The automatic alignment apparatus according to claim 7, wherein each driving unit and power transmission unit includes:

a motor installed at one side of the plate;

a shaft of the motor, protruded downwardly from the lower part of the plate;

a first timing pulley fixed to the shaft;

a shaft of one alignment rod, protruded from the lower part of the plate;

a second timing pulley fixed to the shaft of the alignment rod;

a first timing belt to connect the first timing pulley and the second timing pulley;

a third timing pulley and a fourth timing pulley having the same size and respectively fixed to the lower parts of the alignment rods; and a second timing belt to connect the third timing pulley and the fourth timing pulley.

9. The automatic alignment apparatus according to claim 7, wherein a second sensing unit to sense a consumption state of rubber bands temporarily banded onto the alignment rods is installed at one side of the alignment rods.

10. The automatic alignment apparatus according to claim 7, wherein an outer distance between the alignment rods is larger than an outer distance of a rubber band to be aligned.

11. The automatic alignment apparatus according to claim 7, wherein the screw grooves are formed at the same pitch and the same depth in the same direction.

12. The automatic alignment apparatus according to claim 7, wherein left heights of the screw grooves are the same and right heights of the screw grooves are the same.

* * * * *